US005551580A

United States Patent [19]

Knutson

[11] Patent Number: 5,551,580

[45] Date of Patent: Sep. 3, 1996

[54] SLIDABLE STORAGE WALL-MOUNT

[76] Inventor: Brian C. Knutson, 245 - 12th Ave. East, West Fargo, N. Dak. 58078

[21] Appl. No.: 372,356

[22] Filed: Jan. 13, 1995

[51] Int. Cl.[6] ..... A47F 5/00

[52] U.S. Cl. ..... 211/94

[58] Field of Search ..... 211/94, 105.3, 211/162, 123

[56] References Cited

U.S. PATENT DOCUMENTS

| | | | |
|---|---|---|---|
| 596,380 | 12/1897 | Pursley | 211/94 |
| 1,132,190 | 3/1915 | Kohout | 211/94 |
| 2,917,185 | 12/1959 | Kovacs | 211/94 |

*Primary Examiner*—Alvin C. Chin-Shue
*Assistant Examiner*—Sarah L. Purol
*Attorney, Agent, or Firm*—David A. Lingbeck

[57] ABSTRACT

A slidable storage wall-mount comprising a generally rectangular, thin, and elongate member having a front side, a back side, and a groove extending in the back side and along the length of the elongate member, and further comprising a rail member having flanges at the ends thereof and being attachable to a wall, a track which is fixedly disposed in the groove and is slidably and securely mounted upon the rail member, and a plurality of hanger members disposed in the front side of the elongate member for holding and storing objects. The storage wall-mount can be mounted in hard-to-reach places out of view such as beside appliances next to walls. Instead of the user having to reach around appliances and in between appliances and walls to either remove or hang objects or items from the hanger members as in conventional peg boards for instance, the storage wall-mount allows the user to slide the elongate member out into the open and to easily and conveniently remove or hang objects on the storage wall-mount and then to slide the elongate member back out of the way.

12 Claims, 3 Drawing Sheets

SLIDABLE STORAGE WALL-MOUNT

BACKGROUND OF THE INVENTION

This invention relates to a slidable storage wall-mount which holds and stores, in particular, household items such as brooms, mops, and even nonhousehold items such as wearing apparel including caps, hats, and coats, and which can be conveniently mounted on walls in hard-to-reach areas such as beside major household appliances and even in closets as such.

Stationary wall mounts comprising slats having hooks, pegs, and other holding means disposed thereon are well known in the art for holding, supporting, and storing brooms, mops, hats, coats, and shoes. These wall mounts are conventionally fastened to the wall and cannot be moved upon the wall and provide a means for storing, in particular, household goods in convenient reachable places which tend to be out in the open.

One known stationary wall mount is a WALL-MOUNTED TOP SUPPORT, U.S. Pat. No. 5,335,799, INVENTED BY Douglas L. Coudron, which comprises an upper support member for supporting an elongated handle of a mop and comprises a lower support member for supporting the mop head, the upper support member and the lower support member being fastened to the wall.

These stationary wall mounts can be mounted to walls in convenient, easy-to-reach places but would be practically useless in less convenient places like beside appliances such as refrigerators. Whereas, the present invention stores the same items in those hard-to-reach places and gives the user more space and allows the user to use what would otherwise be wasted space.

SUMMARY OF THE INVENTION

The present invention relates to a slidable storage wall-mount comprising a slat having a groove in the backside and extending along the length thereof and further having a plurality of hanger members disposed in the front side and spaced along the length thereof for supporting objects such as household goods or wearing apparel. The wall-mount further comprises a rail member attached with bolts or the like to a wall, and a track fixedly attached in the groove on the back side of the slat and slidably and securely mounted upon the rail member with the backside of the slat facing and proximate the wall or closely spaced from the wall.

One objective of the present invention is to provide a slidable storage wall-mount which can be conveniently attached to a wall in hard-to-reach places but yet is easily accessible to the user.

Another objective of the present invention is to provide a slidable storage wall-mount which allows the user to store and hang objects out of view and out of the way, but which can be easily moved into view and into easy reach by the user.

Further objectives and advantages of the present invention will become apparent as the description proceeds and when taken in conjunction with the accompanying drawings wherein:

DETAILED DESCRIPTION OF THE INVENTION

Figure 1:
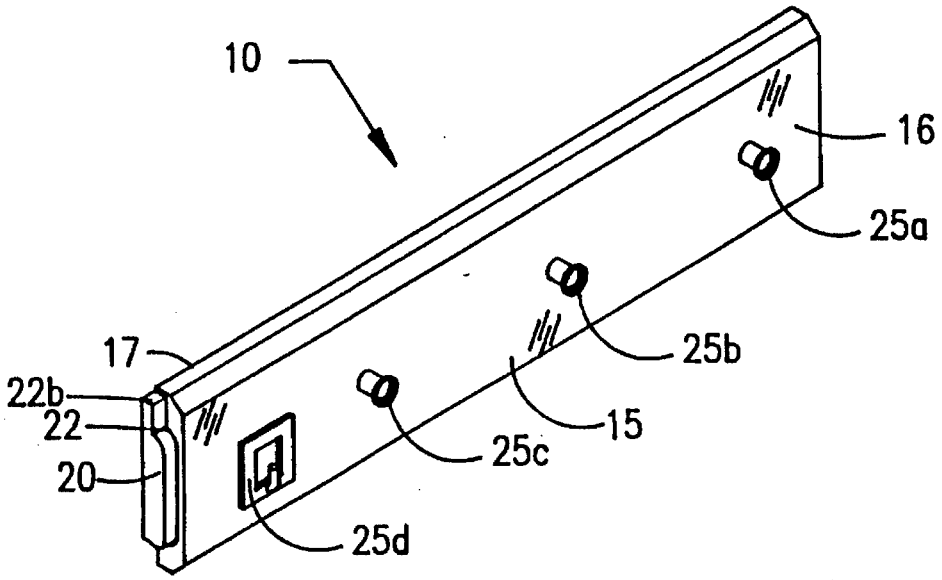
FIG. 1 is a front perspective view of the slidable storage wall-mount.
Figure 2:
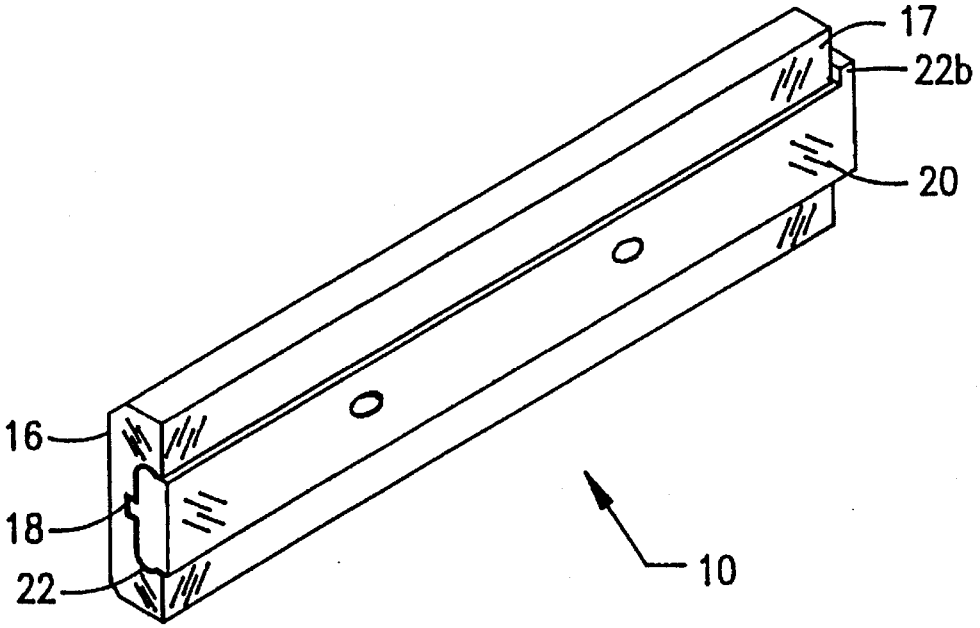
FIG. 2 is a rear perspective view of the slidable storage wall-mount retractably disposed.
Figure 3:
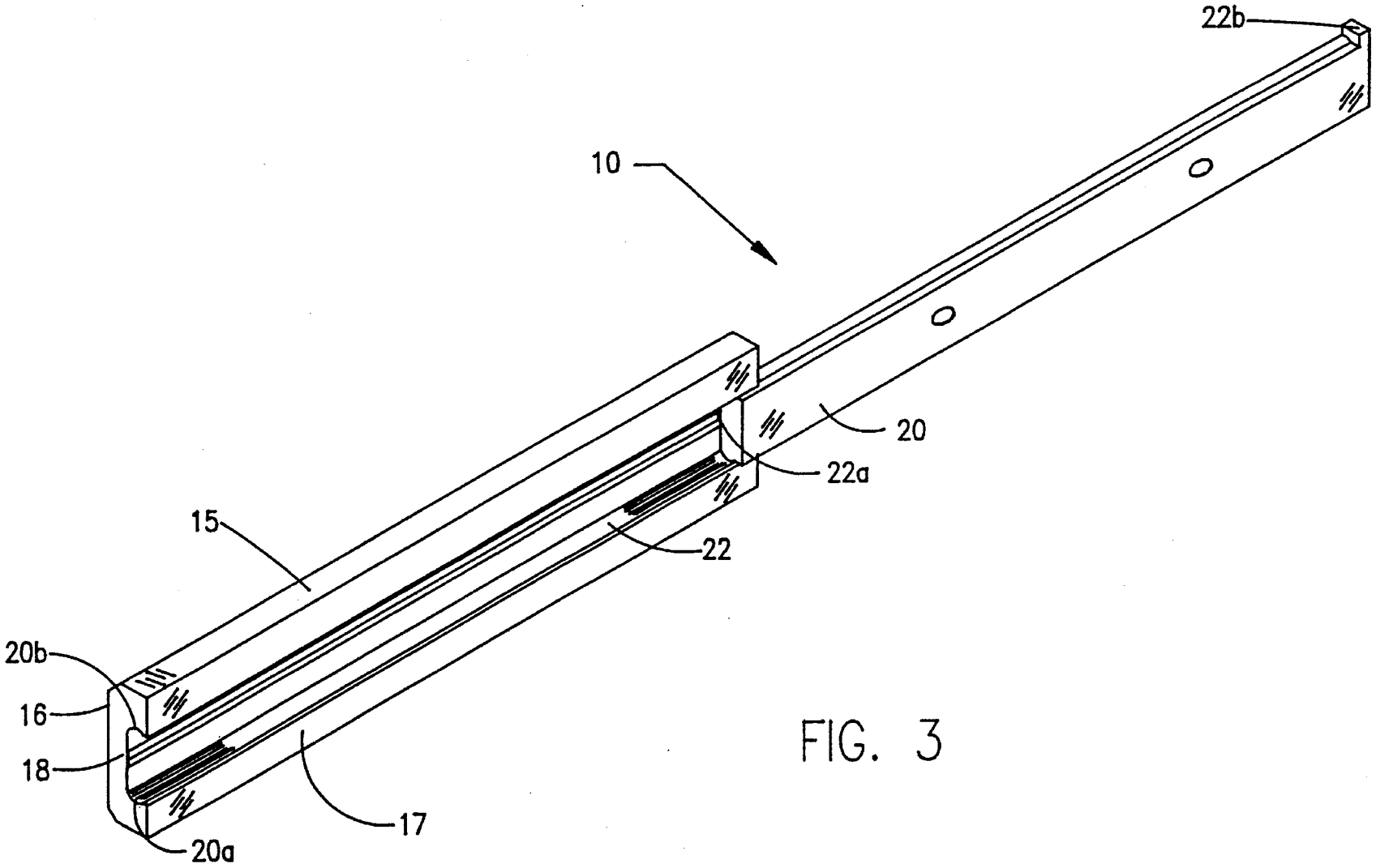
FIG. 3 is a rear perspective view of the slidable storage wall-mount extensibly disposed.

Referring to the drawings in FIGS. 1–4, in particular, the slidable storage wall-mount 10 comprises a slat or a thin, elongate member 15 having a generally flat front side 16, a generally flat back side 17, and a groove 18 extending in the back side 17 and along the length of the elongate member 15. The storage wall-mount 10 further comprises four hanger members 25*a–d* spaced apart and disposed in the front side 16 of the elongate member 15, a rail member 22 attached with bolts or the like to a wall and having flanges 22*a–b* at the ends thereof, and a generally C-shaped track 20 disposed or seated in the groove 18 and fixedly attached to the elongate member 15 and adapted to slidably and securely mount upon the rail member 22. The track 20 further has stop members 20*a–b* perpendicularly disposed at the ends thereof, which, in cooperation with the flanges 22*a–b*, prevent the track 20 from coming off the rail member 22. The track 20 can be slid upon the rail member 22 as far as the flanges 22*a–b* and stop members 20*a–b* allow, that being when the flanges 22*a–b* come into contact with and are stopped by the stop members 20*a–b*.

Figure 4:
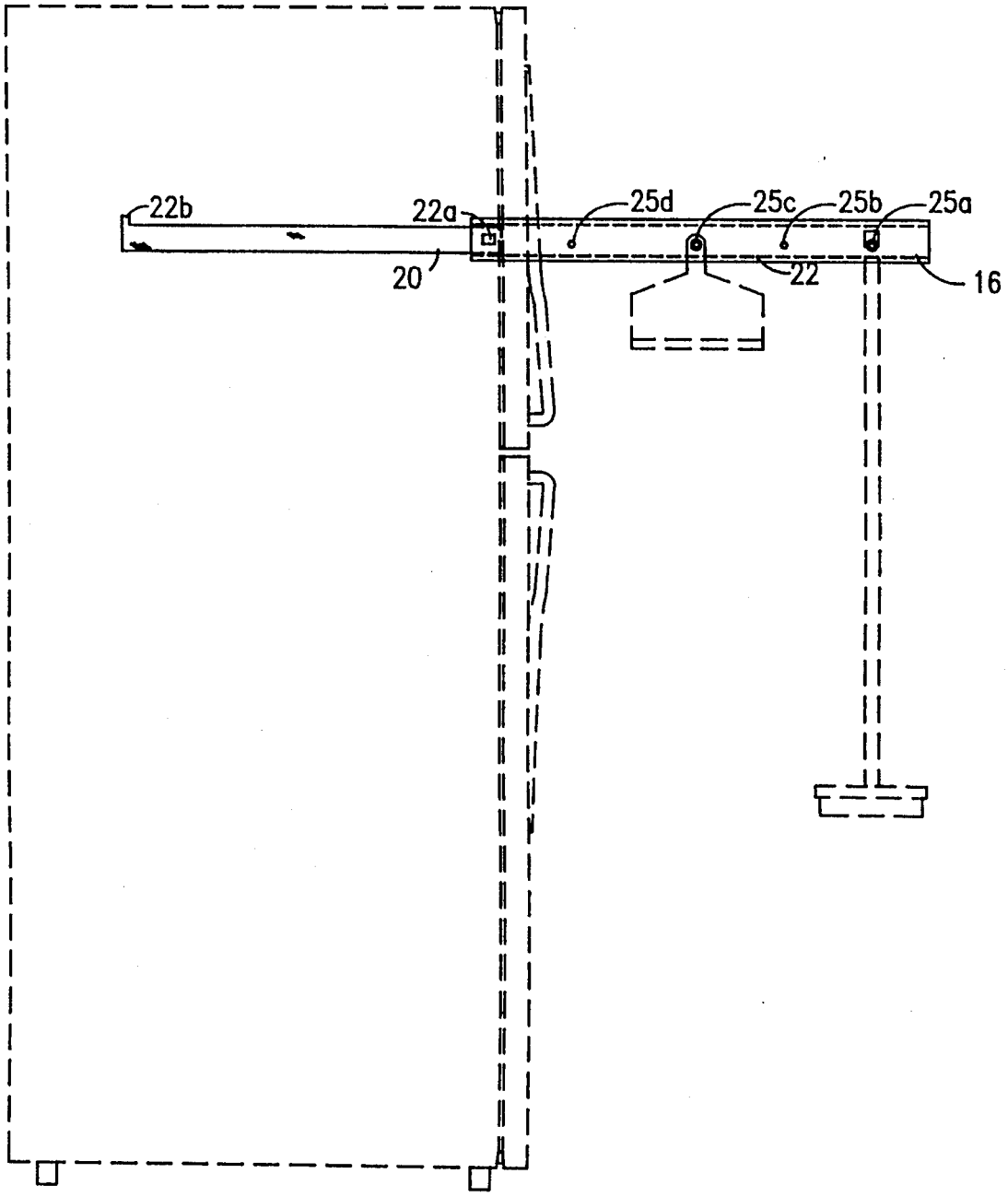
FIG. 4 a front elevation view of the slidable storage wall-mount mounted to a wall behind a refrigerator with objects hanging from the wall-mount.

The storage wall-mount 10 can be attached to most any wall including what would otherwise be very hard-to-reach or not-easily-accessible places or in closely confined places such as between an appliance such as a refrigerator 30 and a wall or on the side walls of closets. To mount and use the storage wall-mount 10, the user slides the track 20 and elongate member 15 to one side of the rail member 22 and then using fasteners such as nails or bolts fixedly attaches the rail member 22 to the wall with the elongate member 15 which is fixedly attached to the track 20 capable of freely moving or sliding upon the rail member 22. Most any object or objects can be hung upon the hanger members 25*a–d* which are generally aligned along the elongate member 15, and can be stored out of the way and generally out of view especially for not the most eye-appealing items such as brooms 36 and dust pans 35. As illustrated in FIG. 4, the elongate member 15 can be extensibly slid out into the open out from beside an appliance 30 or closely confined place, for example, to allow the user to either place items 35 & 36 upon the hanger members 25*a–d* which includes pegs or hooks or remove items thereupon, and then can be retractably slid out of the way and out of view back between the appliance and the wall or in a closet for example.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A slidable storage wall-mount comprising:

a generally thin, elongate member having a front side, a back side, and a groove extending in the back side and along the length of said elongate member;

a track fixedly attached in said groove of said elongate member;

a rail member upon which said track is slidably and securely mounted, said rail member being fixedly attachable to a wall; and a plurality of hanger members spacingly disposed in said front side of said elongate member for supporting items.

2. A slidable storage wall-mount as described in claim 1, wherein said track is adapted and dimensioned to be received in said groove such that when said wall-mount is mounted upon said wall, said elongate member is indistinguishably and closely spaced from said wall.

3. A slidable storage wall-mount as described in claim 2, wherein said track is fixedly and substantially seated in said groove and generally extends the length of said groove.

4. A slidable storage wall-mount as described in claim 2, wherein said track has a pair of stop members at ends thereof, which are engageable to said rail member to prevent said track from coming off said rail member.

5. A slidable storage wall-mount as described in claim 3, wherein said rail member has a pair of flanges at ends thereof, which are engageable to said stop members to prevent said track from coming off said rail member.

6. A method of using a slidable storage wall-mount comprising the steps of:

mounting said slidable storage wall-mount upon a wall, said wall-mount including a generally thin, elongate member having a groove extending in a back side thereof, a track fixedly received in said groove, a rail member upon which said track is slidably and securely mounted, and a plurality of hanger members disposed on a front side of said elongate member for supporting items;

extensibly sliding said elongate member relative to said rail member for convenient accessibility of said hanger members;

suspending or removing said items from said hanger members; and retractably sliding said elongate member for storing said items.

7. A method of using a slidable storage wall-mount as described in claim 6, wherein the step of mounting said wall-mount includes mounting said wall-mount on a not-easily-accessible wall.

8. A method of using a slidable storage wall-mount as described in claim 7, which further includes mounting said wall-mount in a closely confined place.

9. A method of using a slidable storage wall-mount as described in claim 8, includes mounting said wall-mount on a wall beside an appliance.

10. A method of using a slidable storage wall-mount as described in claim 8, includes mounting said wall-mount on a wall in a closet.

11. A method of using a slidable storage wall-mount as described in claim 8, wherein the step of extensibly sliding said elongate member further includes extensibly sliding said elongate member in the open from said closely confined place for easy and convenient access by a user.

12. A method of using a slidable storage wall-mount as described in claim 11, further includes retractably sliding said elongate member out of the open into said closely confined place to store said items suspended upon said hanger members.

* * * * *